US008910498B2

(12) United States Patent
Saucier et al.

(10) Patent No.: US 8,910,498 B2
(45) Date of Patent: Dec. 16, 2014

(54) LOCKOUT CABINET

(75) Inventors: Mario Saucier, Chicoutimi (CA); Sylvain Deschênes, Chicoutimi (CA)

(73) Assignee: 6251374 Canada Inc., Chicoutimi (CA)

( * ) Notice: Subject to any disclaimer, the term of this patent is extended or adjusted under 35 U.S.C. 154(b) by 522 days.

(21) Appl. No.: 13/281,147

(22) Filed: Oct. 25, 2011

(65) Prior Publication Data

US 2013/0099641 A1 Apr. 25, 2013

(51) Int. Cl.
*E05B 65/52* (2006.01)

(52) U.S. Cl.
USPC ..... 70/63; 70/164; 70/DIG. 63; 109/53; 109/67; 109/68; 206/1.5; 220/4.22; 220/481; 220/482; 220/521; 312/245; 312/327; 312/328

(58) Field of Classification Search
USPC ..... 70/63, 164, DIG. 63, 158, 159, 166, 70/170; 109/53, 54, 64, 67, 68, 73, 75, 76; 206/1.5, 570, 575, 578, 579; 220/810, 220/521, 480–482, 751, 833–835, 4.22; 312/245, 327, 328
See application file for complete search history.

(56) References Cited

U.S. PATENT DOCUMENTS 1,473,001 A * 11/1923 White ..... 200/43.14
1,566,856 A * 12/1925 Gregory ..... 220/377
1,592,405 A * 7/1926 Worley, Jr. et al. ..... 70/81
1,709,239 A * 4/1929 Ver Wiebe ..... 248/553
1,742,075 A * 12/1929 Houghten ..... 220/810
1,931,372 A * 10/1933 Brown ..... 220/377
2,434,242 A * 1/1948 Hermes ..... 211/99
2,450,722 A * 10/1948 Drije ..... 248/311.2
2,595,752 A * 5/1952 Batts ..... 248/224.8
2,940,183 A * 6/1960 Fromberg ..... 33/539
3,125,873 A * 3/1964 Robinson ..... 70/63
3,667,259 A 6/1972 Reque et al.
3,983,976 A * 10/1976 Taylor ..... 190/18 R
4,006,324 A 2/1977 Leasher et al.
4,462,317 A * 7/1984 Franko et al. ..... 109/45
4,520,945 A * 6/1985 Hodge ..... 220/315
4,748,716 A * 6/1988 Bentz et al. ..... 16/237
5,181,619 A * 1/1993 Noble ..... 209/702
5,270,803 A 12/1993 Fairhurst
5,365,757 A 11/1994 Primeau
5,769,006 A * 6/1998 Allaer ..... 109/73

(Continued)

FOREIGN PATENT DOCUMENTS

EP 0831199 A2 3/1998

*Primary Examiner* — Lloyd Gall
(74) *Attorney, Agent, or Firm* — Sutherland Asbill & Brennan LLP

(57) ABSTRACT

The lockout cabinet can comprise a body with a front opening circumscribed by a front edge, and a rear wall recessed from the front edge, for receiving lockout equipment, a first side laterally opposite a second side, and a tab extending from the first side, passed the front edge, and having a plurality of shackle engagement apertures interspaced from one another in an orientation parallel to an adjacent portion of the front edge; and a door matching the shape of the front opening, being hingedly connected to the second side of the body and having a slot shaped and positioned for the tab to extend through it when the door is closed, with the plurality of shackle engagement apertures on a side of the door opposite the body, able to receive a corresponding plurality of padlock shackles for preventing subsequent unauthorized opening of the door.

15 Claims, 5 Drawing Sheets

(56) References Cited

U.S. PATENT DOCUMENTS

| | | | | |
|---|---|---|---|---|
| 5,772,007 | A | 6/1998 | Frye | |
| 5,873,481 | A * | 2/1999 | Gruhn et al. | 220/210 |
| 5,887,715 | A * | 3/1999 | Vasudeva | 206/373 |
| 5,971,515 | A * | 10/1999 | Baker et al. | 312/329 |
| 6,129,400 | A * | 10/2000 | Jakubiec et al. | 296/37.14 |
| 6,273,289 | B1 * | 8/2001 | Bowman | 220/570 |
| 6,321,925 | B1 * | 11/2001 | Crouse et al. | 220/4.27 |
| 6,752,092 | B2 * | 6/2004 | Beattie et al. | 109/75 |
| 6,963,037 | B1 | 11/2005 | Bennett et al. | |
| 6,997,333 | B2 * | 2/2006 | Howard | 211/85.9 |
| 7,251,967 | B2 * | 8/2007 | Yang | 70/63 |
| 7,360,380 | B2 | 4/2008 | Van Handel | |
| 7,870,767 | B2 | 1/2011 | Brojanac et al. | |
| 2002/0050155 | A1 | 5/2002 | Babbitt, III | |
| 2003/0146220 | A1 * | 8/2003 | Kaura | 220/481 |
| 2004/0226610 | A1 | 11/2004 | McEnerney | |
| 2005/0199628 | A1 | 9/2005 | Van Handel et al. | |
| 2006/0042331 | A1 * | 3/2006 | Benda | 70/63 |
| 2006/0151306 | A1 | 7/2006 | Lau et al. | |
| 2006/0230794 | A1 * | 10/2006 | Liu | 70/63 |
| 2006/0283215 | A1 | 12/2006 | Manthe et al. | |
| 2007/0214695 | A1 | 9/2007 | Frank et al. | |
| 2007/0256844 | A1 | 11/2007 | Blasing et al. | |
| 2008/0210577 | A1 | 9/2008 | Van Handel et al. | |
| 2008/0314298 | A1 * | 12/2008 | McCarthy et al. | 109/64 |
| 2012/0198895 | A1 * | 8/2012 | De Maria | 70/63 |
| 2013/0127318 | A1 * | 5/2013 | Chen et al. | 312/327 |
| 2014/0054293 | A1 * | 2/2014 | Goodfield | 220/495.06 |

* cited by examiner

LOCKOUT CABINET

FIELD

The improvements generally relate to the field of equipment used in lockout procedures, and more particularly to a cabinet for lockout procedure equipment.

BACKGROUND

Lockout procedures are put in place to ensure that a piece of equipment cannot be turned on, pressurized or switched on accidentally while an employee is working on it. These safety procedures typically involve one or more personal locks (padlocks), typically bearing the worker's name, and to which only the worker has the key. The lock needs to be removed to allow operation of the equipment. The piece of equipment can thus be said to be locked-out.

A lockout procedure for a given piece of machinery can require one or more lockout devices such as gate valve lockout devices, breaker switch lockout devices, safety clasp lockout devices, which are used on the piece of equipment and to which locks are attached to prevent removal.

In a single lockout, the worker checks the number and the description of the equipment and then attaches his or her personal lock as well as an instruction label.

In a multiple lockout, the person in charge of the lockout obtains the lockout cards from the department. The person in charge of the lockout follows the instructions on the lockout card, using a lockout box and the departmental locks. Once the lockout is completed, the person in charge of the lockout places an instruction label on the equipment or power source that was locked out. This person also signs and dates the lockout card, thus authorizing the workers to carry out the work, places the keys from all the departmental locks in the lockout box and attaches a departmental lock and an instruction label to the equipment. The lockout card is stored with the lockout box. The lockout box is placed in the predetermined lockout area. Each worker directly involved reads the lockout card and, if he judges it to be satisfactory for his own safety, attaches his personal lock to the lockout box. In case of a reasonable doubt, any worker must personally check the locked out (sealed) articles, before placing his lock on the lockout box. The person in charge of the lockout is the last to remove his lock or the departmental lock, after checking that the workers have completed their job and have removed their individual locks. When all the locks have been removed, the lockout card is returned to the head or his representative of the department concerned, indicating that the work is completed.

The lockout box typically consisted of a box having a chest-like configuration which had certain limitations. There remained room for improvement.

SUMMARY

In accordance with one aspect, there is provided a lockout cabinet comprising: a body with a front opening circumscribed by a front edge, and a rear wall recessed from the front edge, for receiving lockout equipment, a first side laterally opposite a second side, and a tab extending from the first side, passed the front edge, and having a plurality of shackle engagement apertures interspaced from one another in an orientation parallel to an adjacent portion of the front edge; and a door matching the shape of the front opening for engagement therewith, being hingedly connected to the second side of the body and having a slot shaped and positioned for the tab to extend through it when the door is closed into engagement with the front opening, with the plurality of shackle engagement apertures exposed on a side of the door opposite the body, able to receive a corresponding plurality of padlock shackles for preventing subsequent opening of the door.

The lockout cabinet can be used to store keys of departmental locks, for instance, in which case key hooks are provided on the rear wall to receive the keys. Alternately, the lockout box can be used for storing other forms of lockout equipment, in which case a mounting plate having an adapted setup can be provided against the rear wall.

Many further features and combinations thereof concerning the present improvements will appear to those skilled in the art following a reading of the instant disclosure.

DESCRIPTION OF THE FIGURES

In the figures.

DETAILED DESCRIPTION

Figure 1:
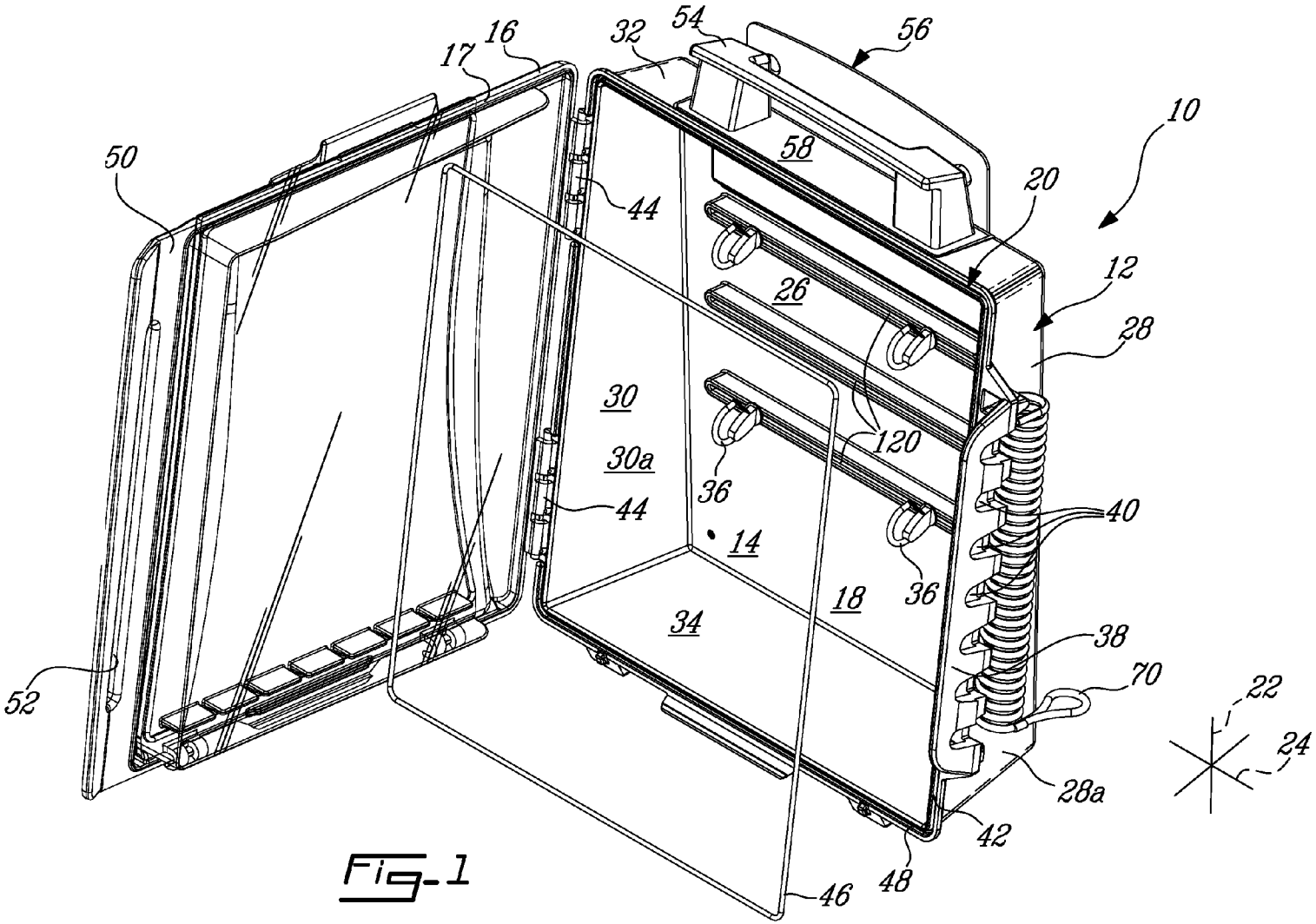
FIG. 1 is an oblique view of a lockout cabinet, shown with the door open.

FIG. 1 shows an example of a lockout cabinet 10. The lockout cabinet 10 can be seen to generally include a body 12 having an internal volume defining a lockout equipment compartment 14, and a door 16. The lockout equipment compartment 14 is accessible via a front opening 18 which is circumscribed by a front edge 20 of the body 12, and the door 16 is closable against the front edge 20, to close the access.

For the purpose of reference, a vertical orientation 22 and a horizontal orientation 24 are defined herein relative to the lockout cabinet 10. The vertical orientation 22 and the horizontal orientation 24 correspond to the vertical and horizontal when the lockout cabinet 10 is in its designed use.

The body 12 has a rear wall 26 which is recessed from the front edge 20 and forms the rear limit to the lockout equipment compartment 14. The body 12 also has a first side wall 28 (forming a first side 28*a*) opposite a second side wall 30 (forming a second side 30*a*), and a top wall 32 opposite a bottom wall 34. Attachments 36 for receiving lockout equipment can be secured to the rear wall 26. In this example, the attachments 36 are hooks destined to receive keys of departmental locks. The body 12 also has a tab 38 which extends from the first wall 28 (which can be the right side wall for example) past the front opening 18 and front edge 20. The tab 38 has a plurality of shackle apertures 40 provided to receive shackles of corresponding padlocks. The shackle apertures 40 are interspaced from one another along the tab 38, along an orientation which is parallel to the orientation of an adjacent portion 42 of the front edge 20.

The door 16 is hinged 44 to the second side 30*a* of the body 12 and has a rim 17 shaped to match the shape of the front edge 20 when it is closed. More specifically, in this embodiment, an optional o-ring 46 is provided in a corresponding groove 48 formed in the front edge 20 of the body 12, to form a waterproof seal with the rim 17 of the door 16 when the door 16 is closed. The door 16 has an extension 50 protruding laterally, away from the hinge 44, in which a slot 52 is provided. The slot 52 is shaped and positioned to match the tab 38 in a manner that the tab 38 extends through the slot 52 when the door 16 is closed such as shown in FIG. 2, with the shackle apertures 40 on a side of the door 16 opposite the body 12, to receive padlocks which can lock the lock cabinet 10 in a closed state.

In this embodiment, the lockout cabinet 10 is provided with an optional handle 54 and wall mount. More particularly, an L-shaped bracket 58 has a first flange 60 affixed to the top wall 32 of the body 12, and a second flange 62 extending behind the rear wall 26, with a gap 64 being formed behind the rear wall 26 and the second flange 62. The handle 54 is affixed to the top wall 32 through the first flange 60. The wall mount 56 is in the form of a hook plate with a first flange 66 mountable to a vertical surface such as a wall, and an upturned flange 68. When holding the lockout cabinet 10 from the handle 54, one can raise it, engage the upturned flange 68 in the gap 64, and let it down into the configuration shown in FIG. 3. Preferably, the space left between the handle 54 and the wall mount 56 and the L-shaped bracket 58 is sufficient to allow an easy grasp of a large hand wearing gloves. An optional cable 70 can also be provided for applications where the lockout cabinet 10 simply rests on the ground, for instance, to lock the lockout cabinet 10 to a fixed structure in a manner similar to locking a bicycle.

Figure 2:
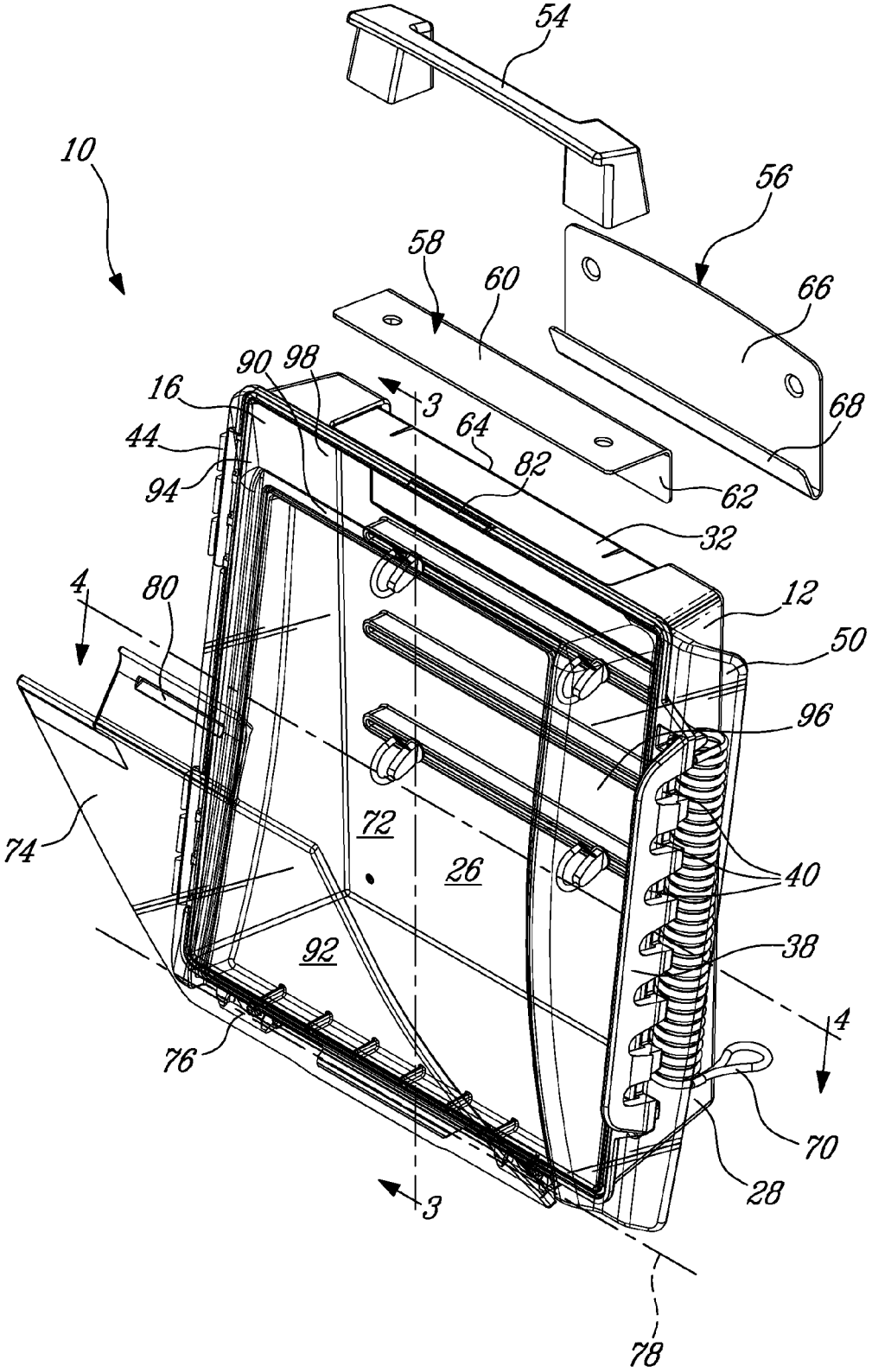
FIG. 2 is an oblique view of the lockout cabinet of FIG. 1, shown with the door closed and lockout card compartment open.
Figure 3:
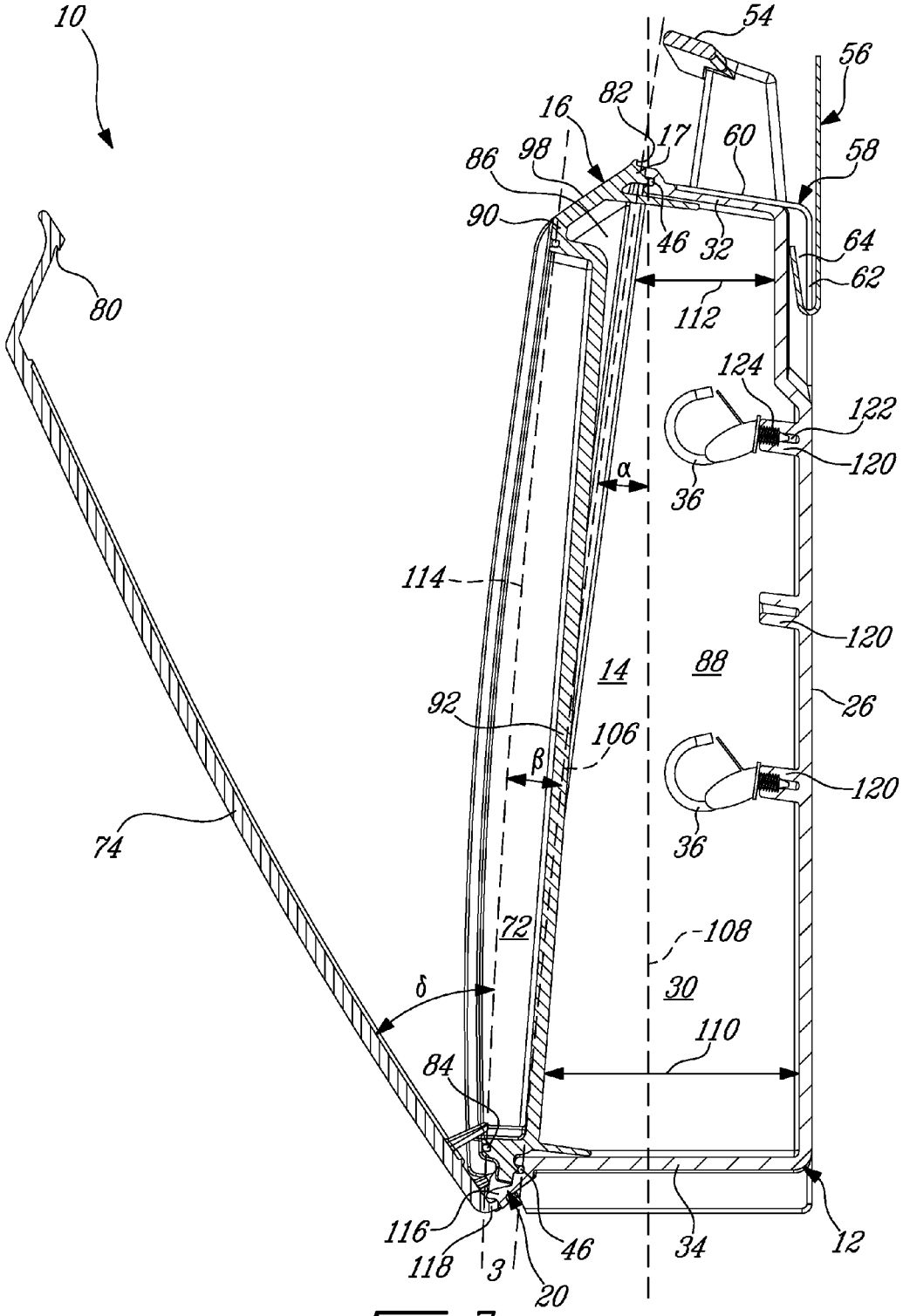
FIG. 3 is a cross-sectional view taken along cross-sectional lines 3-3 of FIG. 2.

Referring now to FIGS. 2 and 3, in this embodiment, the door 16 is shaped with a lockout card compartment 72 which is external to the lockout equipment compartment 14 formed inside the body 12. The lockout card compartment 72 has a closure flap 74 which is hingedly connected 76 about a horizontal axis 78 at the bottom of the door 16. The closure flap 74 in this example has a hook 80 is snappingly engageable with a corresponding notch 82 at an upper portion of the door to hold the lockout card (not shown) trapped behind. The closure flap 74 is transparent to allow viewing the lockout card without having to open the closure flap 74. In this specific embodiment, an o-ring 84 is provided at a periphery of the lockout card compartment 72 on the door 16 to form a water proof seal with the closure flap when the closure flap 74 is closed. The lockout card compartment 72 is optional.

Referring more particularly to FIG. 3, the interface plane 106 between the door 16 and the body 12 is inclined relative to a vertical plane 108 parallel to the rear wall 26 by an acute angle $\alpha$. In turn, the hinge 44 connecting the door 16 to the body 12 is inclined by the same acute angle $\alpha$. The lower wall 34, or base wall, is thus broader than the top wall 32. This can help providing a stabler base when the lockout cabinet 10 rests on a horizontal surface, lowering its center of gravity. Further, the inclination $\alpha$ of the hinge 44 imparts a partially upward motion as the door opens, more particularly, the bottom of the extension 50 swings both outwardly and upwardly as the door 16 opens, facilitating manual access and preventing the bottom of the door 16 to drag against the ground when the lockout cabinet 10 is used resting on the ground. Accordingly, the depth of the body 12 is greater in a lower portion 110 than in an upper portion 112. In this example, a plane 114 of the center panel 90 of the door 16 is inclined from the interface plane 106 between the door 16 and the body 12 toward the vertical. This provides or an additional amount of internal volume 86 to be available, especially in complement to the narrower upper portion 112 of the body 12 where it is the greatest. This can be useful to provide a greater amount of space to the lockout equipment compartment 14, to house the lockout card compartment 72, or both, for example.

For practicality purposes, a stop 116 can be provided to prevent the opening of the closure flap 74 of the lockout card compartment 72 past a certain angle $\delta$. In this embodiment, the stop 116 is provided as part of the body 12 and comes into abutment with a lower abutment portion 118 of the closure flap 74 when the closure flap 74 is opened to the angle $\delta$.

Referring back to FIG. 2, in this embodiment, the door 16 has a convex shape with a door internal volume 86 formed therein. The door internal volume 86 is complementary to the internal volume 88 formed by the body 12 to provide a given total lockout equipment compartment volume 14 for the lockout equipment contained therein. The door internal volume 86 can be in excess of the volume of the lockout card compartment 72. The central portion of the door can be referred to as the center panel 90. In this example, a recess 92 in the center panel 90 forms the lockout card compartment 72. Further, in this example, the door 16 has inwardly inclined walls 94, 96, 98 extending obliquely between the central panel 90 and the rim 17. These include a first side wall 96, a second side wall 94 opposite the first side wall 96, and a top wall 98 in this embodiment.

Figure 4:
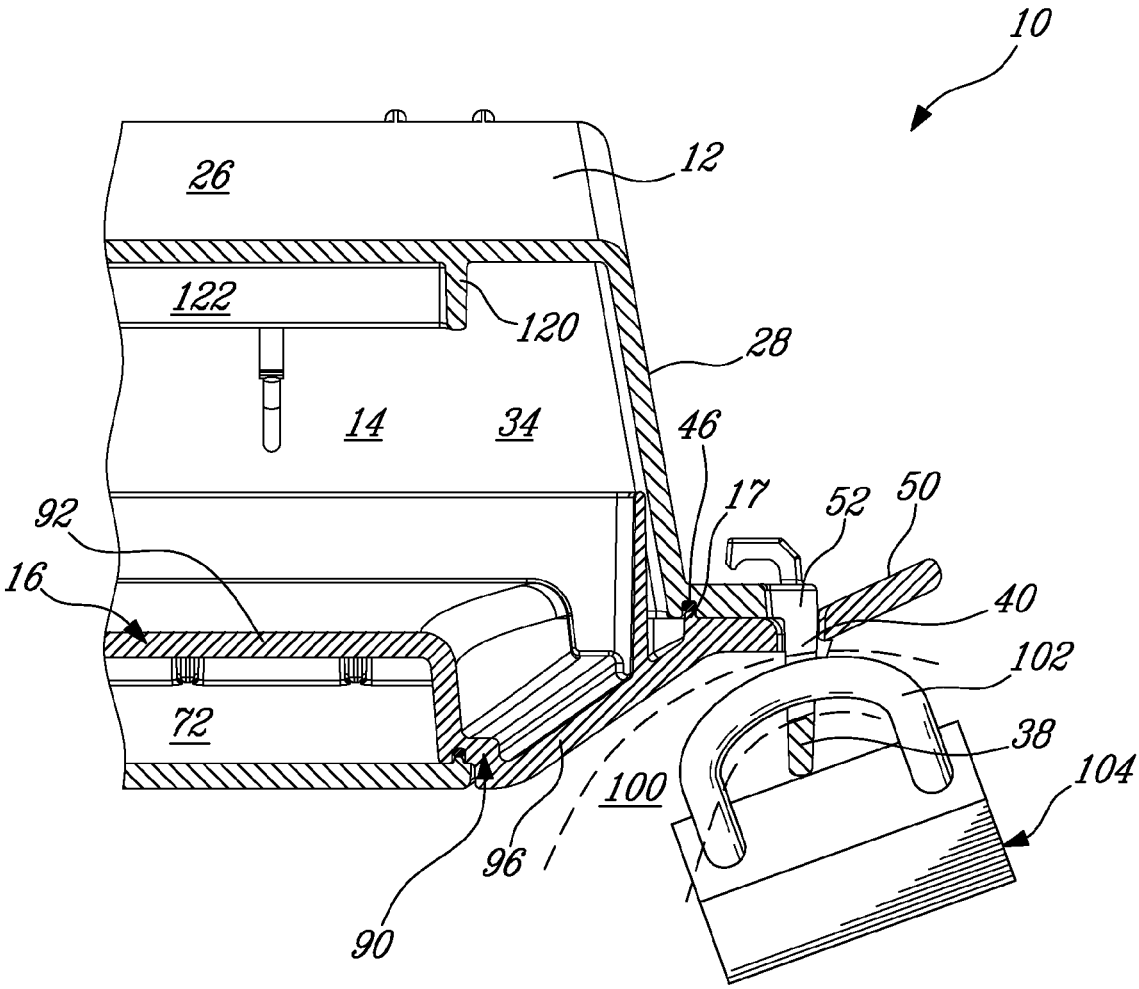
FIG. 4 is a cross-sectional view taken along cross-sectional lines 4-4 of FIG. 2.

The inclination of the first side wall 96 is shown in FIG. 4 and contributes to provide a free area for a shackle engagement path 100 along which the shackle 102 of a padlock can travel upon their engagement with the shackle apertures 40. Further, in this embodiment, the door 16 is made of a transparent plastic material, and the angle inclination of the walls 94, 96, 98 in the door 16 are conveniently oriented to allow visual access to the contents of the lockout cabinet 10 even when it is closed.

The inclined top wall 98, the inner sloping angle of which is shown more clearly in FIG. 3, can particularly be useful in allowing visual access to the contents of the lockout cabinet 10 when it rests on a horizontal surface, whereas the inclined side walls 96, 94 can be useful either when the lockout cabinet is either resting on a horizontal surface or mounted to a wall. The inward sloping angle of the second side wall 94 is the same as the angle of the first side wall 96 in this specific embodiment.

Figure 5:
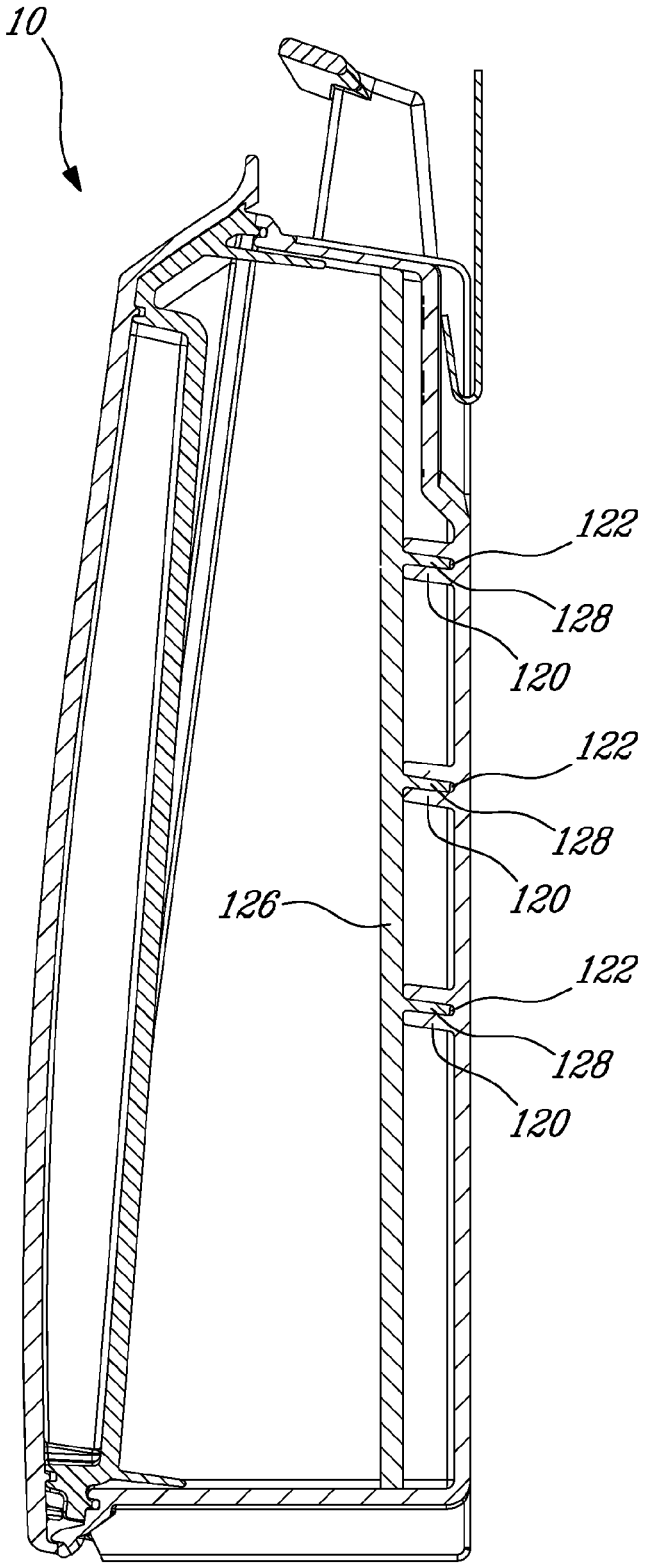
FIG. 5 is an alternative to FIG. 4, where a mounting plate is used to receive lockout equipment instead of key hooks.

Referring to FIGS. 1 and 3, in the embodiment illustrated, a plurality of apertured protrusions 120 are provided on the rear wall 26 of the body 12. In this example, the apertured protrusions 120 are each formed with an elongated slot 122 formed therein. These apertured protrusions 120 are oriented horizontally and interspaced vertically from one another in this particular embodiment and form means to receive attachments for lockout equipment. In accordance with a first embodiment shown in FIG. 3, the attachments are key hooks 36 which have a screw anchor 124 threadingly engaged into the plastic material of the slots 122 of the apertured protrusions 120. In an alternate embodiment, shown in FIG. 5, the attachments can be provided in the form of a mounting plate 126 having a specifically adapted attachment setup on the front face (not shown), and a plurality of engagement tabs 128 corresponding in shape to the apertures in the apertured protrusions 120 for snug or interference engagement therewith. In this embodiment, the apertures of the apertured protrusions 120 are in the form of slots 122, but it will be understood that they can be of circular form or of other shapes in alternate embodiments. The position, number, and configuration can vary in alternate embodiments.

In this embodiment, the body 12, door 16 and closure flap 74 are made entirely of plastic and are configured, as shown, in a manner that the hinges can be assembled or disassembled without requiring tools. This is advantageous in several aspects, including the ease of disassembly when considering recycling of the product at the end of its life cycle. As detailed above, it is preferred to provide the door and closure flap in a transparent plastic material to allow visual access to the contents, and the body can be opaque, optionally of a bright color such as yellow or orange to favour visibility and safety.

As can be seen therefore, the examples described above and illustrated are intended to be exemplary only. The scope is indicated by the appended claims.

What is claimed is:

1. A lockout cabinet comprising: a body comprising a front opening circumscribed by a front edge, a rear wall extending vertically and recessed from the front edge, a first side laterally opposite a second side, and a tab extending from the first side past the front edge and having a plurality of shackle engagement apertures interspaced from one another in an orientation parallel to an adjacent portion of the front edge; and a door that corresponds to the shape of the front opening for engagement with the front edge, the door being hingedly connected to the second side of the body by a first hinge and having a slot shaped and positioned for the tab to extend through it when the door is closed into engagement with the front edge, with the plurality of shackle engagement apertures exposed on a side of the door opposite the body, wherein the front opening of the body slopes outwardly at an acute angle relative to the rear wall, with a lower portion of the body being deeper than an upper portion thereof, an axis of the first hinge also being at the acute angle and providing a partially upward movement when opening the door, wherein the door comprises a convex shape away from the body that defines an internal volume, with a first side wall and a laterally opposite second side wall leading to a center panel which is angled toward the vertical when the door is closed, wherein the center panel of the door comprises a recess defining a lockout card compartment, and a transparent closure flap for the lockout card compartment, the transparent closure flap being hinged to a lower edge of the door, and being snappingly engageable to an upper edge of the door to be kept shut or be openable to access the lockout card compartment.

2. The lockout cabinet of claim 1 wherein the door has an extension extending from the first side wall, away from the first hinge, the extension having the slot defined therein.

3. The lockout cabinet of claim 2 wherein the first side wall is inclined inwardly towards the body between an area of engagement with the front edge and the center panel, the inclination providing a clear shackle path.

4. The lockout cabinet of claim 1 wherein the first side wall, the second side wall, and an upper wall of the door are all inclined inwardly towards the body between an area of engagement with the front edge and the center panel, and are transparent to allow viewing within the body when the door is closed.

5. The lockout cabinet of claim 1 further comprising a stop wherein, when the transparent closure flap is opened, a lower edge of the transparent closure flap comes into abutment with the stop which prevents its opening past a given angle.

6. The lockout cabinet of claim 5 wherein the stop is a portion of the body.

7. The lockout cabinet of claim 5 further comprising a water proof seal between the transparent closure flap and the door.

8. The lockout cabinet of claim 1 wherein the rear wall has a plurality of vertically interspaced, horizontally oriented, apertured protrusions.

9. The lockout cabinet of claim 8 in combination with hooks, the hooks having a screw anchor threadingly engaged into the apertured protrusions.

10. The lockout cabinet of claim 8 in combination with a mounting plate, the mounting plate having a plurality of vertically interspaced tabs extending from a rear face thereof, the plurality of tabs being snugly engageable with the plurality of apertured protrusions.

11. The lockout cabinet of claim 1 further comprising a water proof seal between the door and the body.

12. The lockout cabinet of claim 1 wherein the body and the door comprise plastic components.

13. The lockout cabinet of claim 1, further comprising an L-shaped bracket having a first flange secured on a top wall of the body and a second flange extending behind the rear wall, and a gap being formed between the second flange and the rear wall.

14. The lockout cabinet of claim 13 in combination with a handle secured to the L-shaped bracket.

15. The lockout cabinet of claim 13 in combination with a hook plate having a wall mount flange securable to a vertical surface and an upturned flange engageable into the gap to hold the lockout cabinet against the vertical surface.

* * * * *